United States Patent [19]

Bolte et al.

[11] Patent Number: 4,497,570

[45] Date of Patent: Feb. 5, 1985

[54] PRINTING MACHINE EMPLOYING AN OPERATOR REPLACEABLE INTERPOSITION WEB AND PHOTOCONDUCTIVE MEMBER

[75] Inventors: Steven B. Bolte, Rochester; Grace T. Brewington, Fairport; Theodore Davidson, Rochester; Richard F. Koehler, Jr., Webster; Robert G. Martin, Irondequoit, all of N.Y.

[73] Assignee: Xerox Corporation, Stamford, Conn.

[21] Appl. No.: 463,099

[22] Filed: Feb. 2, 1983

[51] Int. Cl.[3] ..... G03G 15/00

[52] U.S. Cl. ..... 355/16; 355/3 BE

[58] Field of Search ..... 355/3 BE, 11, 16, 3 R, 355/3 TR

[56] References Cited

U.S. PATENT DOCUMENTS

| | | | |
|---|---|---|---|
| 2,990,278 | 6/1961 | Carlson | 118/131 X |
| 3,722,992 | 3/1973 | Zweig | 355/3 BE |
| 3,778,841 | 12/1973 | Gundlach et al. | 355/3 BE X |
| 3,927,934 | 12/1975 | Hayward | 355/3 R |
| 3,937,572 | 2/1976 | Gaynor et al. | 355/3 R X |
| 4,021,106 | 5/1977 | Gaynor | 355/3 R |

*Primary Examiner*—A. C. Prescott

*Attorney, Agent, or Firm*—H. Fleischer; J. E. Beck; R. Zibelli

[57] ABSTRACT

A printing machine having an operator removable housing comprising a photoconductive member with a web entrained about a portion thereof. A latent image is recorded on the photoconductive member and marking particles transported to the portion of the web entrained about the photoconductive member. In this way, the latent image recorded on the photoconductive member attracts the marking particles to the web in image configuration. A copy sheet is advanced into contact with the marking particles on the web. The marking particles interposed between the web and the copy sheet are heated. After cooling, the copy sheet is separated from the web with the marking particles remaining affixed thereto.

14 Claims, 4 Drawing Figures

PRINTING MACHINE EMPLOYING AN OPERATOR REPLACEABLE INTERPOSITION WEB AND PHOTOCONDUCTIVE MEMBER

This invention relates generally to an electrostatographic printing machine for reproducing an original document on a copy sheet. More particularly, the printing machine of the present invention includes a housing having a photoconductive member and an interposition web mounted therein. The housing is arranged to be operator removable from the printing machine after a preselected number of copies have been made. After removing the used housing, the operator replaces it with an unused housing.

Generally, in the process of electrostatographic printing, as exemplified by electrophotographic printing, a photoconductive member is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. The developer material is attracted to the electrostatic latent image to form a powder image which is subsequently transferred to a copy sheet. Thereafter, the powder image is permanently affixed to the copy sheet in image configuration.

It has been found that the cost of a printing machine may be significantly reduced by implementing the concept of throw-away components. Thus, it is highly desirable to be capable of using relatively inexpensive components within the printing machine and, after the expiration of their useful life, replacing these components. In order to be economically competitive, these components must be readily replaceable by the machine operator. The utilization of a web over a photoconductive surface lends itself to the concept of throw-away or operator replaceable components. Hereinbefore, the web has been interposed between the photoconductive member and the development system after a latent image has been recorded on the photoconductive surface. In this way, the developer material is attracted from the development system to the web by the latent image recorded on the photoconductive surface. Thereafter, the powder image developed on the web is transferred to a copy sheet and permanently affixed thereto. Various approaches have been devised to implement this technique. The following disclosures appear to be relevant:

U.S. Pat. No. 2,990,278, Patentee: Carlson, Issued: June 27, 1961. U.S. Pat. No. 3,927,934, Patentee: Cook, Issued: Dec. 23, 1975. U.S. Pat. No. 3,937,572, Patentee: Gaynor et al., Issued: Feb. 10, 1976. U.S. Pat. No. 4,021,106, Patentee: Gaynor, Issued: May 3, 1977.

The pertinent portions of the foregoing disclosures may be briefly summarized as follows:

Carlson discloses charging a photoconductive drum, exposing the charged portion and developing the latent image recorded thereon. The developed powder image is transferred to a belt and heated forming a tacky powder image on the belt. A copy sheet is brought into contact with the tacky powder image. The tacky powder image is transferred to the copy sheet.

Cook describes charging a photoconductive drum and exposing the charged portion to record a latent image thereon. A web is wrapped around a portion of the drum. The web advances from a supply cassette to a storage cassette. As the web is interposed between the latent image recorded on the drum and a development system, the development system moves a liquid developer material into contact with the web to form a developed image thereon. The image developed on the web is then brought into contact with the copy sheet. Under the influence of pressure, the developed image transfers to the copy sheet.

Gaynor et al. and Gaynor disclose charging a photoconductive drum and wrapping an insulative, transparent belt about the charged portion of the drum. The charged portion of the drum is exposed through the belt to record a latent image thereon. As the drum and belt pass through a development station, toner particles are attracted by the latent image to the belt. The powder image is then transferred to a copy sheet and permanently affixed thereto.

In accordance with the features of the present invention, there is provided a printing machine having a housing mounted therein. The housing is operator removable from the printing machine after a preselected number of copies have been made and operator replaceable with an unused housing. A photoconductive member is mounted in the housing. A web, mounted in the housing, is entrained about a portion of the photoconductive member. Means record a latent image on the photoconductive member. Means transport marking particles to the portion of the web entrained about the photoconductive member so that the latent image recorded thereon attracts the marking particles to the web in image configuration. Means are provided for advancing a copy sheet into contact with the marking particles on the web. Means heat the marking particles interposed between the web and the copy sheet. Means separate the copy sheet from the web after the copy sheet has cooled so that the marking particles remain affixed to the copy sheet.

Other aspects of the present invention will becme apparent as the following description proceeds and upon reference to the drawings, in which.

While the present invention will hereinafter be described in conjunction with a specific embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
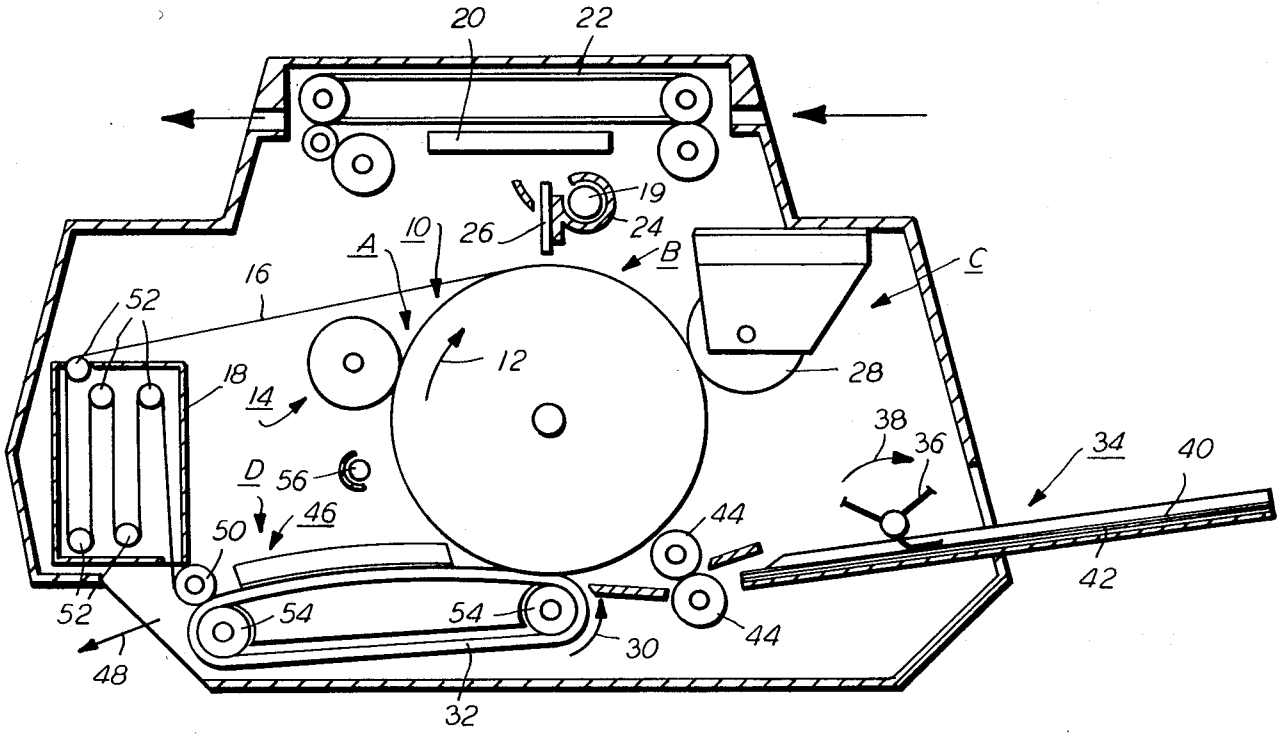
FIG. 1 is a schematic elevational view depicting the printing machine of the present invention therein.

For a general understanding of the features of the present invention, reference is made to the drawings. In the drawings, like reference numerals have been used throughout to designate identical elements. FIG. 1 of the drawings schematically depicts the various components of an electrostatographic printing machine incorporating the features of the present invention therein. It will become evident from the following discussion that these features are equally well suited for use in a wide variety of printing machines, and are not necessarily limited in their application to the particular embodiment depicted herein.

As shown in FIG. 1, the printing machine employs a photoconductive drum having a photoconductive surface deposited on a conductive substrate. Preferably, the photoconductive surface is made from a zinc oxide with the conductive substrate being made from an aluminum alloy. Drum 10 rotates in the direction of arrow 12 to advance successive portions of the photoconductive surface through the various processing stations disposed about the path of movement thereof.

Initially, a portion of the photoconductive surface passes through charging station A. At charging station A, a roller, indicated generally by the reference numeral 14, charges photoconductive surface 12 to a relatively high substantially uniform potential. By way of example, charging roller 14 is of the type described in U.S. Pat. No. 3,172,024 issued to Gundlach in 1956, the relevant portions of the foregoing patent being hereby incorporated into the present application.

After the photoconductive surface of drum 10 is charged, web 16 advances into contact therewith. Web 16 is entrained about a portion of photoconductive drum 10 and extends in an endless path. Additional lengths of web 16 are stored in housing 18. The various process elements, e.g. exposure, development, fusing, etc. impose a number of constraints on the material of web 16. For exposure, web 16 must be made from an uncharged substantially transparent material. For development, the dielectric thickness of web 16 must be sufficiently small to allow penetration of the electric fields from the latent image recorded on the photoconductive surface into the developer material. For transfer, web 16 must be an insulating material. For fusing, the surface web 16 must have a low surface energy or be coated with a material of low surface energy. In addition, web 16 must retain its mechanical strength at the elevated temperatures occurring during fusing. Suitable materials for web 16 are transparent, high temperature plastics such as polyamides, polysulfones, polyethersulfones, polyimides and fluoropolymers or their equivalents. The thickness of web 16 may range from 0.00065 centimeters to 0.013 centimeters with the preferred range being from 0.00065 centimeters to 0.006 centimeters. High surface energy materials, e.g. polyimides, may be coated with fluoropolymers or silicone polymers in order to obtain low surface energy.

Next, the charged portion of the photoconductive surface is advanced through exposure station B. At exposed station B, web 16 is in contact with the photoconductive surface of drum 10. Web 16 is maintained under tension so that it may conform to the relatively rough surface of the zinc oxide photoconductive. Exposure station B includes a light source 19, preferably an elongated tungsten lamp. Light source 19 is disposed stationarily beneath platen 20. Endless document belt 22 advances an original document across platen 20. In this way, light source 19 illuminates incremental portions of the original document moving therepast on the platen 20. An opaque shield 24 surrounds light source 19. Shield 24 has a slit therein so that the light rays from light source 19 are projected onto the original document disposed facedown on transparent platen 20. As the original document is moved therepast by belt 22, successive incremental portions thereof are illuminated. Light rays reflected from the original document are transmitted through a bundle of image transmitting fibers, indicated generally by the reference numeral 26. Image transmitting fibers 26 are bundled gradient index optical fibers. U.S. Pat. No. 3,658,407 issued to Kitano et al. in 1972 describes a light conducting fiber made of glass and synthetic resin which has a refractive index distribution in cross section thereof that varies consecutively and parabolically outwardly from a central portion thereof. Each fiber acts as a focusing lens to transmit part of an image placed at, or near, one end thereof. An assembly of fibers, in a staggered two-row array, transmits and focuses a complete image of the object. The fiber lenses are produced under the tradename "SELFOC"; the mark is registered in Japan and owned by Nippon Sheet Glass Company, Ltd. These radiant index lens arrays are used as a replacement for conventional optical systems in electrophotographic printing machines, such use being disclosed in U.S. Pat. No. 3,947,106 issued to Hamaguchi et al., in 1976 and U.S. Pat. No. 3,977,777, issued to Tanaka et al. in 1976. The relevant portions of the foregoing patents are hereby incorporated into the present disclosure. The light rays reflected from the original document are transmitted by the image transmitting fibers through transparent web 16 onto the charged portions of photoconductive drum 10 to selectively dissipate the charge thereon. This records an electrostatic latent image on photoconductive drum 10 which corresponds to the informational areas contained within the original document.

After the electrostatic latent image is recorded on the photoconductive surface of drum 10, drum 10 advances the latent image to development station C. Web 16 is entrained about photoconductive drum 10 at development station C. Thus, web 16 is interposed between the photoconductive surface of drum 10 and developer roller 28. Preferably, developer roller 28 includes a non-magnetic tubular sleeve having an elongated rotatably mounted magnet disposed interiorly thereof. A voltage source electrically biases the tubular member to a potential intermediate the background potential and that of the latent image recorded on the photoconductive surface of drum 10. Developer roller 28 advances a developer material into contact with web 16. The latent image recorded on the photoconductive surface of drum 10 attracts the developer material thereto forming a powder image thereon. Preferably, the developer material is an electrically conductive single component developer material made from magnetic toner particles. The conductivity of the toner particles generally ranges from $10^5$ to $10^{10}$ mhos. By way of example, these toner particles may be made from a thermoplastic material comprising at least magnetite and carbon black. The thermoplastic material is selected to melt at a relatively low temperature.

After the powder image is formed on web 16, web 16 advances, as photoconductive drum 10 rotates in the direction of arrow 12, to nip 30 where web 16 is pressed into contact with belt 32 by drum 10. At nip 30, a sheet of support material, i.e. a copy sheet, is advanced and interposed between web 16 and belt 32. The material of belt 32 is selected from any suitable material, e.g. silicone rubber. The resistivity of belt 32 is chosen so that electrical charges can flow to the surface to neutralize the charge of the toner particles on the surface of web 16. This results in the toner particles becoming preferentially attached to the surface of the copy paper rather than the surface of web 16. Thus, highly conductive toner particles can be transferred to a plain paper surface without the use of a corona generating device. One skilled in the art will appreciate that a drum may be used in lieu of belt 32. The copy paper is advanced in a timed sequence with the movement of web 16 so as to be in contact with powder image thereon. The copy sheet is advanced by sheet feeder 34 to nip 30. Preferably, sheet feeder 34 includes a paddle 36 which comprises a rotatably mounted cylinder having a plurality of spaced, flexible vanes extending outwardly therefrom. Paddle 36 rotates in the direction of arrow 38. The free end of each vane of paddle 36 successively engages the uppermost sheet 40 of stack 42. As paddle 36 rotates, sheet 40 is guided into the nip defined by registration roller 44. Registration rollers 44 advance sheet 40, in synchronism with the powder image on web 16 to nip 30. At nip 30, sheet 40 is interposed between the upper surface of belt 32 and web 16. At this point, web 16 having the marking, i.e. toner, particles in image configuration thereon, copy sheet 40 and belt 32 form a sandwich which moves to fusing station D. With the copy sheet, web and belt captured, no image smear or loss of copy sheet control is experienced. As the copy sheet leaves the influence of the fuser, indicated generally by the reference numeral 46, it is cooled. The detailed structure of fuser 46 will be described hereinafter with reference to FIGS. 3 and 4. Copy sheet 40 continues to advance along belt 32 in the direction of arrow 48. Web 16 passes about roller 50 and enters cassette 18. In this way, copy sheet 40 is separated from web 16 after cooling. It has been found that if the copy sheet has sufficient time to cool while still being sandwiched between web 16 and belt 32, web 16 releases almost 100% of the powder image therefrom. By allowing the marking particles, copy sheet and web to cool as a sandwich, the adhesion force of the marking particles to the copy sheet is greater than that of the marking particles to the web. In this way, almost 100% of the marking particles are stripped away from the web and transferred to the copy sheet. After stripping, web 16 continues along its path and enters cassette 18. The copy sheet moves in the direction of arrow 48 and exits the printing machine. Cassette 18 includes a plurality of rollers 52 about which web 16 is entrained. This enables the length of web 16 to be suitably selected so as to increase the electrical relaxation time of web 16, thereby extending the life of web 16 to correspond to the life of the photoconductive drum 10. Preferably, both the life of web 16 and that of photoconductive drum 10 ranges from about 1,000 to about 2,000 copies. Alternatively, photoconductive drum 10 may have a longer life than web 16. Under these circumstances, only web 16 would be periodically replaced.

With continued reference to FIG. 1, belt 32 moves in an endless path and is entrained about a pair of opposed spaced rollers 54. One skilled in the art will appreciate that the subassembly of belt 32 driven by roller assembly 54 may be replaced by a single roller. With a single roller, the printing machine retains the feature of a positive paper path, i.e. the next copy sheet is held in place by pinch mechanisms in the paper tray until the prior copy sheet exits the printing machine.

After leaving nip 30, drum 10 and web 16 are separated from one another. Drum 10 continues to rotate in the direction of arrow 12, the electrostatic latent image recorded thereon then passes beneath discharge lamp 56. Discharge lamp 56 irradiates the photoconductive surface of drum 10 to discharge the charge remaining thereon preparatory for the next successive imaging cycle.

Figure 2:
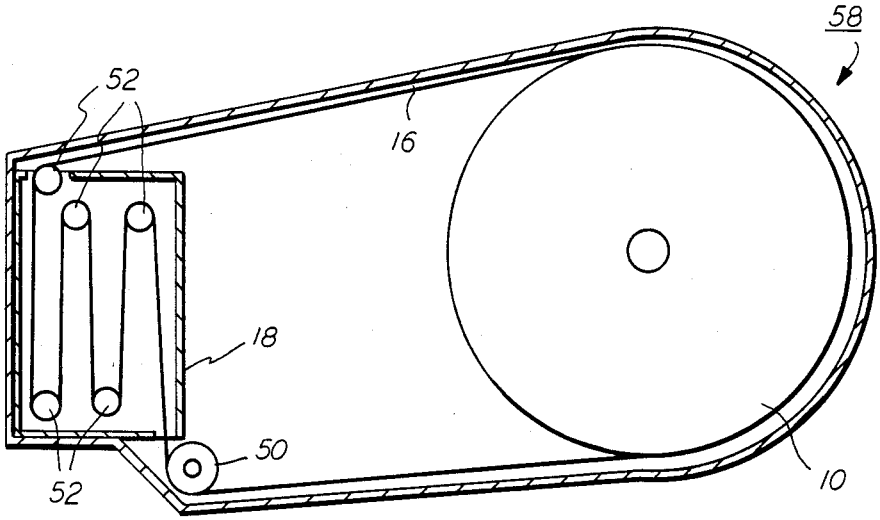
FIG. 2 is a schematic elevational view showing the removable housing of the FIG. 1 printing machine.

The printing machine depicted in FIG. 1 incorporates a throwaway housing 58 (FIG. 2). Housing 58 has the photoconductive drum 10, web 16 and its associate cassette 18 and tensioning roller 50 all mounted therein. The housing snaps into place in the printing machine and after a preselected number of copies, i.e. corresponding to the life of the web and photoconductive drum, is removed from the printing machine. Thus, the housing is operator removable after a preselected number of copies have been made. After removing housing 58 containing the photoconductive drum 10 and web 16, an unused housing 58 is placed in the printing machine. This greatly simplifies the structure of the printing machine and reduces the complexity while improving the servicability thereof. The use of a disposable web allows unique combinations of the process elements into an electrophotographic printing machine which has no high voltage corona generating devices, a positive paper path, ready access to all of the component parts and utilizes highly conductive single component developer material without the need for special copy paper. This feature is derived from the mechanical transfer effected in the web configuration. The detailed structure of housing 58 having the photoconductive drum 10 and web 16 mounted therein is shown in FIG. 2.

Referring now to FIG. 2, housing 58 has photoconductive drum 10 mounted rotatably therein. When housing 58 is inserted in the printing machine, the shaft on which drum 10 is mounted couples with the drive shaft of a motor. In this way, the motor remains integral with the printing machine and is adapted to rotate both the photoconductive drum, and as a result of the friction between drum 10 and web 16, web 16. Roller 50 is resiliently urged into contact with web 16 so as to maintain web 16 under tension. To this end, roller 50 is mounted in a yoke which, in turn, is mounted pivotably in housing 58. A pair of springs resiliently urge the yoke to pivot in a direction such that roller 50 presses against web 16 maintaining it under sufficient tension such that rotation of drum 10 advances web 16 therewith. Web 16 moves in an endless continuous path. Cassette 18 has a plurality of spaced staggered rollers 52 which increase the length of web 16. By increasing the length of web 16, the life thereof is increased in that the totality of the web length is sufficient to print a fixed number of copies corresponding to the life of the photoconductor. Thus, the selected length of web 16 is such that the useful life thereof is about the same as the useful life of the photoconductive drum. Inasmuch as zinc oxide is employed as a photoconductive surface on drum 10, the life of both the web and photoconductive drum ranges from about 1,000 to 2,000 copies. After this number of copies have been reproduced in the printing machine, housing 58 is removed therefrom. A new housing, which is unused, is then inserted into the printing machine and the counting cycle resumed. In this way, successive housings 58 are capable of being operator replaceable in the printing machine at relatively low cost. The size of cassette 18 is such as to contain the requisite additional length of web 16 therein in order to extend the life of web 16 so as to correspond to that of photoconductive drum 10. The utilization of a cassette for storing additional lengths of web enables housing 58 to be smaller in size. Preferably, housing 58 is a molded plastic housing.

Figure 3:
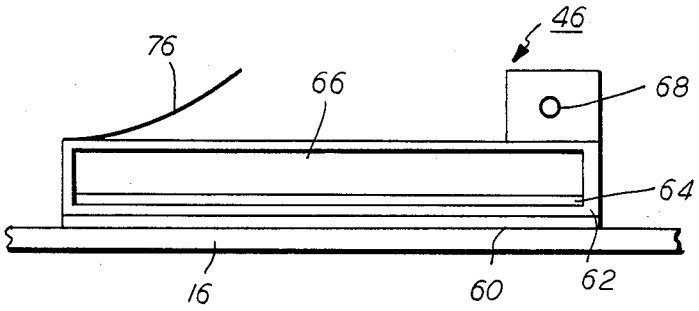
FIG. 3 illustrates one embodiment of the fuser used in the FIG. 1 printing machine.

Turning now to FIG. 3, there is shown one embodiment of fuser 46. As depicted thereat, fuser 46 includes a plurality of foil heater elements 60 mounted in a molded plastic housing 62. A layer of fiber glass 64 is interposed between a layer of sponge 66. In this way, the outer plastic shell 62 remains substantially cool to the touch while foil heating elements 60 contact web 16. Thus, the embodiment of fuser 46 depicted in FIG. 3, comprises a plastic shell 62 having a foil heater 60, a layer of fiberglass 64 and a layer of foam or sponge 66 successively positioned in a direction away from web 16. Foil heater 60 is adapted to be in engagement with web 16. Plastic shell 62 is mounted pivotably about rod 68 in the printing machine so as to be separable from web 16. A spring 70 resiliently urges shell 62 to pivot about rod 68 to position foil heaters 60 in contact with web 16. In general, fuser 46 includes a release type outer material on foil heating element 60 to provide a non-stick surface for engagement with web 16. The foil heating elements 60 are relatively thin and provide instant warm up. A blanket type of temperature sensor may be positioned closely adjacent to the heating elements to provide a closed loop control system maintaining the temperature at the desired level. The heating elements are backed by a layer of fiberglass 64 and insulated with a closed cell foam silicon rubber 66 or dead air space.

Figure 4:
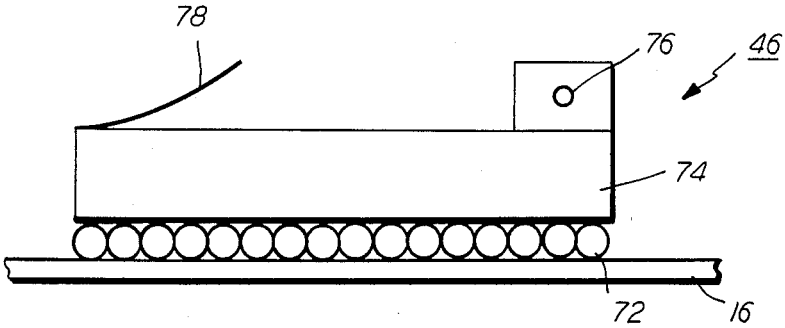
FIG. 4 shows another embodiment of the fuser used in the FIG. 1 printing machine.

Referring now to FIG. 4, there is shown another embodiment of fuser 46. As depicted thereat, a plurality of quartz heating tubes 72 are secured to a plastic shell 74 having a layer of closed cell foam therein for insulation purposes. Shell 74 is mounted pivotably about rod 76 in the printing machine so as to be readily separable from web 16. This allows housing 58 to be easily removed from the printing machine. A leaf spring 78 resiliently urges shell 74 to pivot about axis 76 so as to position quartz tubes 72 in contact with web 16. In this embodiment, the powder image is fixed with a combination of infrared and conductive energy with the copy sheet seeing a decreasing amount of infrared energy as the system warms up to equilibrium and the power delivered to the quartz tubes decreases. Since the quartz surface, i.e. the tube surface is discontinuous, and there is merely a succession of line contacts between the tubes and web 16, there is little likelihood of the web sticking thereto.

It is thus clear that the printing machine of the present invention includes a continuous reusable web adapted to be entrained about and in engagement with a portion of the circumferential surface of a photoconductive drum. The latent image recorded on the photoconductive drum attracts marking particles to the web in contact therewith. These marking particles are then advanced to a nip in synchronism with the transportation of a copy sheet thereto. At the nip, a sandwich is formed of the web, marking particles and copy sheet. This sandwich is advanced to a fuser which heats the marking particle. After cooling, the copy sheet is separated from the web with the marking particles remaining affixed to the copy sheet in image configuration.

It is, therefore, evident that there has been provided in accordance with the present invention a printing machine which fully satisfies the aims and advantages hereinbefore set forth. While this invention has been described in conjunction with a specific embodiment, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A printing machine for producing copies, including:
   - a housing mounted in the printing machine, said housing being operator removable therefrom after a preselected number of copies have been made and operator replaceable with an unused housing;
   - a photoconductive member mounted in said housing;
   - a web mounted in said housing and entrained about a portion of said photoconductive member;
   - means for recording a latent image on said photoconductive member;
   - means for transporting marking particles to the portion of said web entrained about said photoconductive member so that the latent image recorded thereon attracts the marking particles to said web in image configuration;
   - means for advancing a copy sheet into contact with the marking particles on said web;
   - means for heating the marking particles interposed between said web and the copy sheet; and
   - means for separating the copy sheet from said web after the copy sheet has cooled so that the marking particles remain affixed to the copy sheet.

2. A printing machine according to claim 1, wherein said web is arranged to move in an endless path.

3. A printing machine according to claim 2, wherein said web includes a cassette disposed in the endless path of movement thereof and storing an additional length of said web therein so as to increase the useful life of said web.

4. A printing machine according to claim 3, wherein said web is made preferably from a material having a low surface energy.

5. A printing machine according to claim 3, wherein said web is made preferably from a material having a high surface energy coated on the exterior surface thereof with a material having a low surface energy.

6. A printing machine according to claim 3, wherein said photoconductive member is made preferably from at least a zinc oxide material.

7. A printing machine according to claim 3, wherein said heating means includes:
   - a plurality of quartz tubes; and
   - means for resiliently urging said tubes into contact with said web.

8. A printing machine according to claim 3, wherein said heating means includes:
   - a foil heating element; and
   - means for resiliently urging said heating element into contact with said web.

9. A printing machine according to claim 3, wherein said separating means includes means for moving the copy sheet along a path which positions the copy sheet in operative communication with said heating means to heat the marking particles interposed between said web and the copy sheet and removes the copy sheet from the influence of said heating means to enable the marking particles to cool before said moving means advances the copy sheet along a path which spaces the copy sheet from said web.

10. A printing machine according to claim 9, wherein said moving means includes a drum.

11. A printing machine according to claim 9, wherein said moving means includes a belt moving about an endless path.

12. A printing machine according to claim 3, wherein said web is substantially transparent.

13. A printing machine according to claim 12, wherein recording means includes:

means for charging at least a portion of said photoconductive member; and means for transmitting light rays through the portion of said web contacting said photoconductive member to selectively discharge the charged portion of said photoconductive member to record an electrostatic latent image thereon.

14. A printing machine according to claim 3, wherein said web is of a length such that the useful life thereof is substantially equal to the useful life of said photoconductive member.

* * * * *